US006572419B2

(12) United States Patent
Feye-Homann

(10) Patent No.: US 6,572,419 B2
(45) Date of Patent: Jun. 3, 2003

(54) ELECTRICAL CONNECTOR

(75) Inventor: Jürgen Feye-Homann, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 09/985,640

(22) Filed: Nov. 5, 2001

(65) Prior Publication Data

US 2002/0076998 A1 Jun. 20, 2002

(30) Foreign Application Priority Data

Nov. 3, 2000 (DE) ..... 100 54 661

(51) Int. Cl.[7] ..... H01R 4/48
(52) U.S. Cl. ..... 439/839; 439/833; 439/441
(58) Field of Search ..... 439/839, 856, 439/833, 441

(56) References Cited

U.S. PATENT DOCUMENTS

| | | | | | |
|---|---|---|---|---|---|
| 3,662,324 | A | * | 5/1972 | Schumacher | 439/839 |
| 3,781,770 | A | * | 12/1973 | Mancini | 439/839 |
| 4,201,439 | A | * | 5/1980 | M'Sadoques | 439/839 |
| 4,548,459 | A | * | 10/1985 | Mosser, III | 439/839 |
| 4,895,531 | A | * | 1/1990 | Vignoli | 439/839 |
| 5,049,095 | A | * | 9/1991 | Gugelmeyer | 439/839 |

FOREIGN PATENT DOCUMENTS

| | | | | |
|---|---|---|---|---|
| DE | 923 146 | | 2/1955 | |
| DE | 1 989 886 | | 7/1968 | |
| DE | 77 20 751 | | 10/1977 | |
| DE | 3731625 | A1 * | 3/1989 | 439/839 |
| DE | 40 34 094 | | 5/1991 | |
| DE | 195 47 557 | | 6/1997 | |
| DE | 197 29 223 | | 1/1999 | |
| DE | 199 38 068 | | 5/2000 | |
| FR | 2 007 131 | | 1/1970 | |

* cited by examiner

*Primary Examiner*—Renee Luebke
*Assistant Examiner*—Felix O. Figueroa
(74) *Attorney, Agent, or Firm*—Nixon Peabody LLP; David S. Safran

(57) ABSTRACT

Electrical connector with a contact element and an additional spring element, the contact element having a contact zone formed by two contact legs and a bent spring area that applies a contact force to a mating contact element inserted into the contact zone, the additional spring element having two legs and a bridge which connects the legs. The contact force is increased by the additional spring element which is arranged relative to the contact element such that the stretching of the additional spring element is in the direction of the contact force.

12 Claims, 4 Drawing Sheets

ELECTRICAL CONNECTOR

BACKGROUND OF THE INVENTION

1. Field of the Invention

The present invention relates to an electrical connectors or terminals. In particular, the present invention relates to such electrical connectors having a contact element and a spring element, the contact element having a contact zone formed by two contact legs, and a bent spring area which connects the contact legs to the contact zone that apply a contact force to a mating contact element inserted into the contact zone, where the spring element has two legs and a bridge which connects the legs.

2. Description of the Related Art

Electrical connectors or terminals are used to produce an electrically conductive, preferably metallic, connection between a contact element, and a mating contact element. Whether in the specific application there is an electrical terminal or an electrical connection is functionally relatively trivial. As generally used in the art, an electrical terminal exists when something movable is connected to something stationary, while an electrical connection exists when something movable is connected to something else movable, or even when something stationary is connected to something stationary.

The initially described electrical terminal or connector is used to bring a contact element into electrically conductive contact with a mating contact element. The electric terminal or connection therefore interacts functionally with a mating contact element. Correspondingly, the geometry of the mating contact element must be matched to the geometry of the contact element, especially the geometry of the contact zone, so that contact can be made between the contact element and the mating contact element.

Good electrical terminal or connector are typically characterized mainly in that in the contact-making state, the contact resistance between the contact element and the mating contact element is low and also has a permanently constant contact force.

In electrical terminals or connectors of the type under consideration, the contact resistance between the contact element and the mating contact element, which mates with the contact element, is dependent on various factors including the geometry of the contact element and the mating contact element, the materials of the contact element and the mating contact element, and especially on the contact force or the contact pressure between the contact element and the mating contact element. The contact force or the contact pressure is generally achieved by the fact that when contact is made, the contact element is elastically deformed so that from the elastic deformation, a reset force is the contact force which results in a corresponding contact pressure. In other words, the electrical terminal or connector are made such that the contact element acts as a spring element.

One problem is that when using a good conductor for the contact element, the spring constant of the contact element is relative low so that sufficient and permanent contact force cannot be accomplished solely by the contact element. This disadvantage is eliminated in the prior art by an additional spring element of spring steel which serves as an overspring for increasing the contact force. The spring element extends over the contact element, especially the bent spring area of the contact element. In the known electrical terminals or connectors, the spring element is matched in its geometry to the geometry of the contact element. In addition, with reference to the contact element and the contact zone, the spring element is located on the outside, so that the spring force of the additional spring element acts in addition to the existing spring force of the contact element. Such electrical terminal or connector with an additional spring element that provides overspring has the advantage that the contact element itself can be produced from a material with good conductivity, while the high contact pressure which is likewise necessary for good contact is accomplished essentially by the additional spring element.

Electrical terminal or connector of the type under consideration are often inserted into terminal blocks for PE tapping, or in general as flat connectors, conductor bars or the corresponding flat connectors being used as the mating contact element. Due to miniaturization of the terminal blocks, increasingly less space is available for the electrical terminal or connectors. Therefore, both the contact element and also the additional spring element being used as the overspring are made as flat metal parts with only a very low thickness. This however, leads to the spring force of the contact element being exposed to bending stress, and also leads the additional spring element to be exposed to bending stress.

SUMMARY OF THE INVENTION

The primary object of this invention is to provide an electrical connector or terminal of the above described type in which the contact force is further increased in a very simple and economical manner.

The primary object of the invention is attained in accordance with the present invention by providing an additional spring element which is arranged to the contact element such that the stretching of the additional spring element in the direction of the contact force is greater than the stretching perpendicular to the direction of the contact force.

It was stated above that the contact force between the contact element and the mating contact element is achieved in that when contact is made, the contact element is elastically deformed so that a reset force provides the contact force which exerts a corresponding contact pressure stemming from the elastic deformation. The elastic deformation then results from the fact that when a mating contact element is inserted into the contact zone, the contact legs are pressed apart, especially the spring area of the contact element being subjected to bending stress. Therefore, the direction of stress of the contact element acts in an opposite direction to the contact force. Thus, the arrangement of the additional spring element to the contact element can also be described such that the stretching of the additional spring element in the direction of stress is greater than the stretching perpendicular to the direction of stress. The stretching of the additional spring element relates to the cross section so that on the one hand, stretching means thickness of the additional spring element, and on the other hand, the width of the additional spring element.

Due to the execution and arrangement of the additional spring element in accordance with the present invention, the spring element has a much higher spring stiffness in the direction of stress than the oversprings known from the prior art. Like the electrical terminal or connectors known in the prior art, the contact force of the electrical terminal or connector of the present invention is accomplished essentially by the additional spring element which provides the high contact pressure necessary for good contact between the contact element and the mating contact element.

Despite the increase of the contact force, the electrical terminal or connector in accordance with the present invention can be produced easily and thus economically, and both the contact element and also the additional spring element can be produced, for example, simply by punching out and bending.

According to one preferred embodiment of the present invention, the contact element has a recess or a slot in the lengthwise direction and the additional spring element is inserted into the recess or the slot. In this way, the electrical connector or terminal have especially small dimensions since the thickness of the contact element is only slightly increased when the additional spring element is inserted into the slot. The additional spring element can be made advantageously as a retaining ring which has been deformed in an oblong manner, or especially as a SEEGER® circlip ring (a type of retaining ring manufactured by Seeger-Orbis Gmbh Company, Germany and the nature of which is defined by German standard DIN 471) which is deformed in an oblong manner. Here, the retaining ring or the SEEGER® circlip ring is deformed in an oblong manner to the extent that the contact element is made not annular, but rather, is made rectangular.

According to another advantageous embodiment of the present invention, the ends of the contact legs of the contact element are bent in the shape of a wedge or triangle into the contact zone and advantageously, the ends of the legs of the additional spring element are made likewise wedge-shaped or triangular corresponding to the ends of the contact legs. The position of the contact zone is established by the ends of the contact legs which are bent into the contact zone in a wedge shape or triangular shape, and the contact zone is shifted somewhat into the interior of the contact element thereby facilitating the insertion of the mating contact element into the contact element. In addition, due to the ends of the contact legs being bent inwardly in a wedge-shape or triangular shape, recesses on the outside of the contact legs are formed which can be used to attach the additional spring element to the contact element. To do this, the ends of the legs of the additional spring element are likewise made wedge-shaped or triangular so that they can fit into the recesses.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENTS

Initially, it is noted that as used herein, the term "electrical connector" should be generally understood to refer to electrical terminals or electrical connectors, again, the minor difference being that electrical terminal exists when something movable is connected to something stationary, while an electrical connection exists when something movable is connected to something else movable, or when something stationary is connected to something stationary. However, because this difference in application is minor and both components are used to establish an electrically conductive connection, both of these types are referred to herein generically as an "electrical connector".

Figure 1:
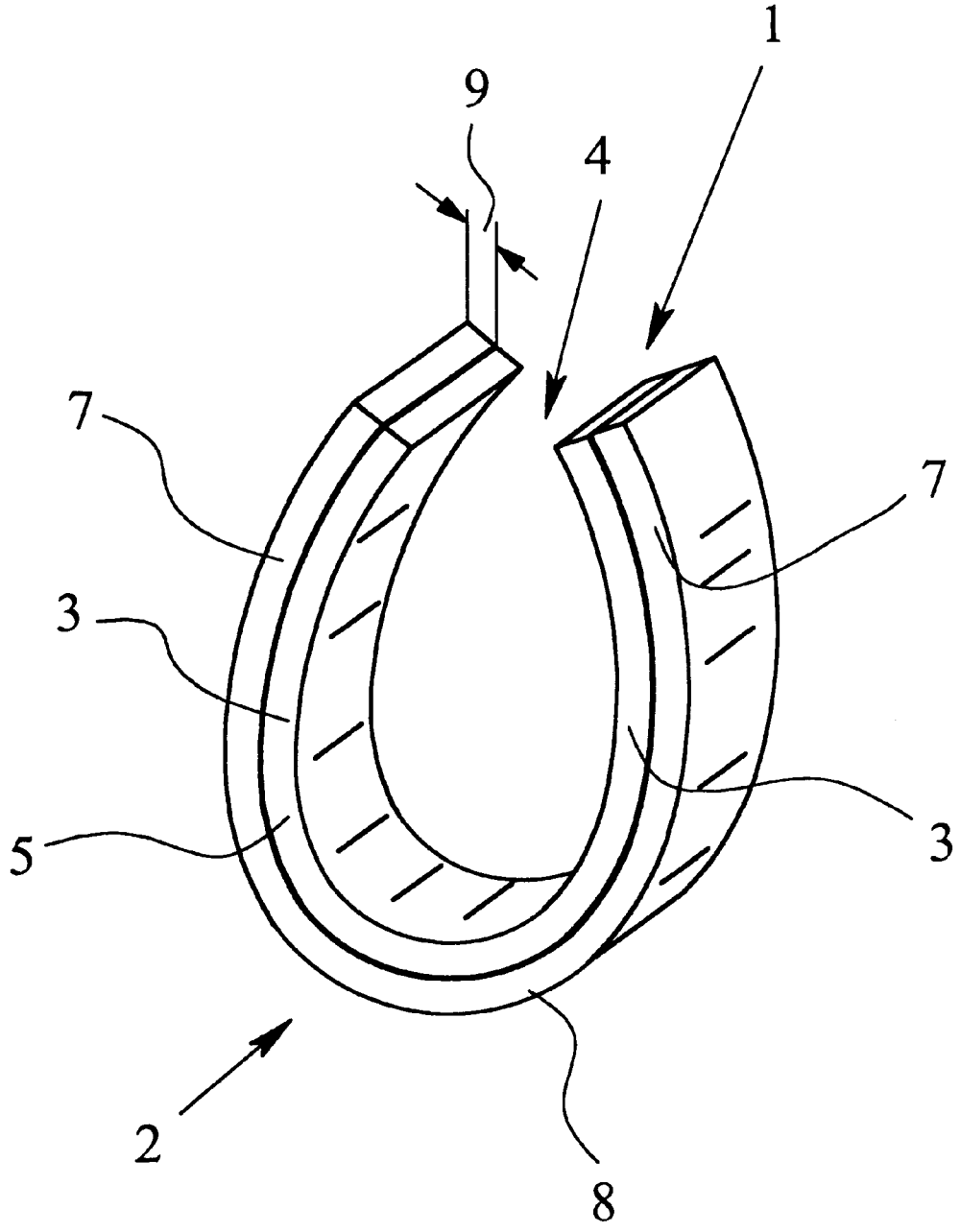
Fig. 1 Prior Art
FIG. 1 shows an electrical connector with a contact element and an additional spring element as an overspring according to the prior art.

FIG. 1 shows an electrical connector known from the prior art with a contact element 1 and with an additional spring element 2, the contact element 1 having a contact zone 4 which is formed by two contact legs 3, and a bent spring area 5 which is connected in one piece to the contact legs 3. While in the contact zone 4 of the contact element 1, contact is made with the mating contact element such as the mating contact element 26 shown in FIG. 3. The spring area 5 is used for elastic deformation of the contact element 1 when the mating contact element 26 penetrates into the contact element 1 and thus, exerts a contact force and a contact pressure between the mating contact element 6 inserted into the contact zone 4, and the contact element 1.

In the known electrical connector shown in FIG. 1, the additional spring element 2 is made as an overspring such that the additional spring element 2 surrounds the contact element 1 and its shape is matched to the shape of the contact element 1. The additional spring element 2 has two legs 7 and a bent bridge 8 which connects the two legs 7. If a mating contact element 6 is inserted into the contact area 4 of the contact element 1, the two contact legs 3 are pressed apart and the spring area 5 of the contact element 1 is stressed by bending against its spring force. From this elastic deformation of the contact element 1, a reset force serves to provide the contact force. As a result, a corresponding contact pressure of the contact legs 3 against the mating contact element 6 inserted into the contact zone 4 is provided.

The reset force resulting from the spring force of the spring area 5 of the contact element 1 is increased in the prior art by the contact element 1 being surrounded by an additional spring element 2. When the contact legs 3 are pressed apart by a mating contact element 26 which is inserted into the contact zone 4, the legs 7 of the additional spring element 2 are also pressed apart. Thus, in addition to the spring area 5 of the contact element 1, the bent bridge 8 of the additional spring element 2 is exposed to bending stress, by which the contact force acting on the mating contact element 26 is increased according to the spring stiffness of the additional spring element 2. However, due to the flat execution of the additional spring element 2 and the resulting relatively small thickness 9 of the spring element 2, the spring stiffness of the electrical connection of the prior art is relatively low.

Figure 2:
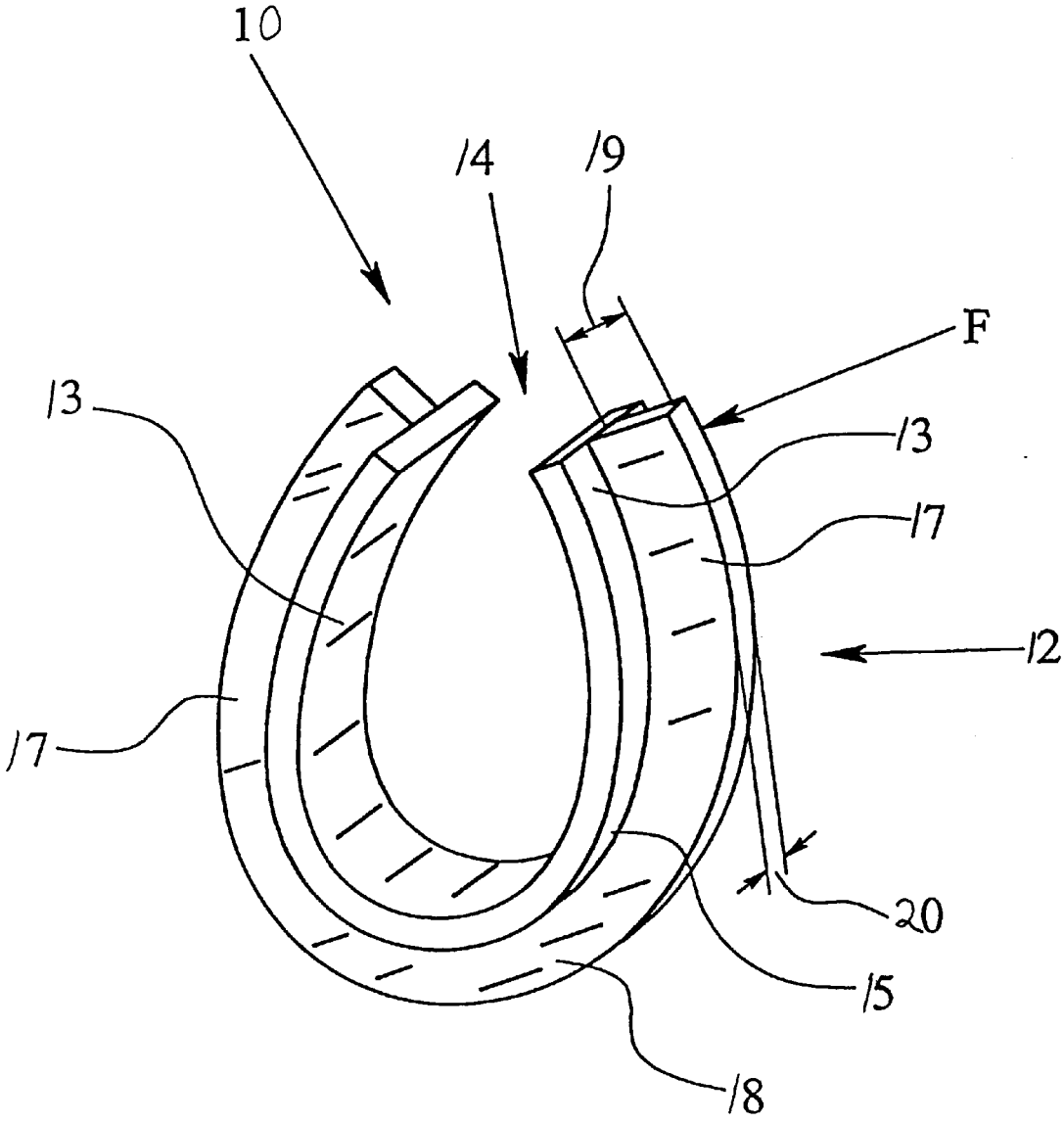
FIG. 2 shows one preferred embodiment of an electrical connector with a contact element and with an additional spring element in accordance with the present invention.

The electrical connection in accordance with the present invention shown in FIG. 2 differs from the known prior art electrical connector shown in FIG. 1 in that the additional spring element 12 is made and arranged on the contact element 10 such that the stretching of the additional spring element 12 in the direction of the contact force F is greater than the stretching perpendicular to the direction of the contact force F. For the additional spring element 12 shown in FIG. 2, the spring element 12 has a rectangular cross section which means that its thickness 19 is greater than its width 20. Here, the thickness 19 corresponds to the stretching of the additional spring element 12 in the direction of the contact force F while the width 20 corresponds to the stretching of the spring element 12 perpendicular to the direction of the contact force F.

Figure 3:
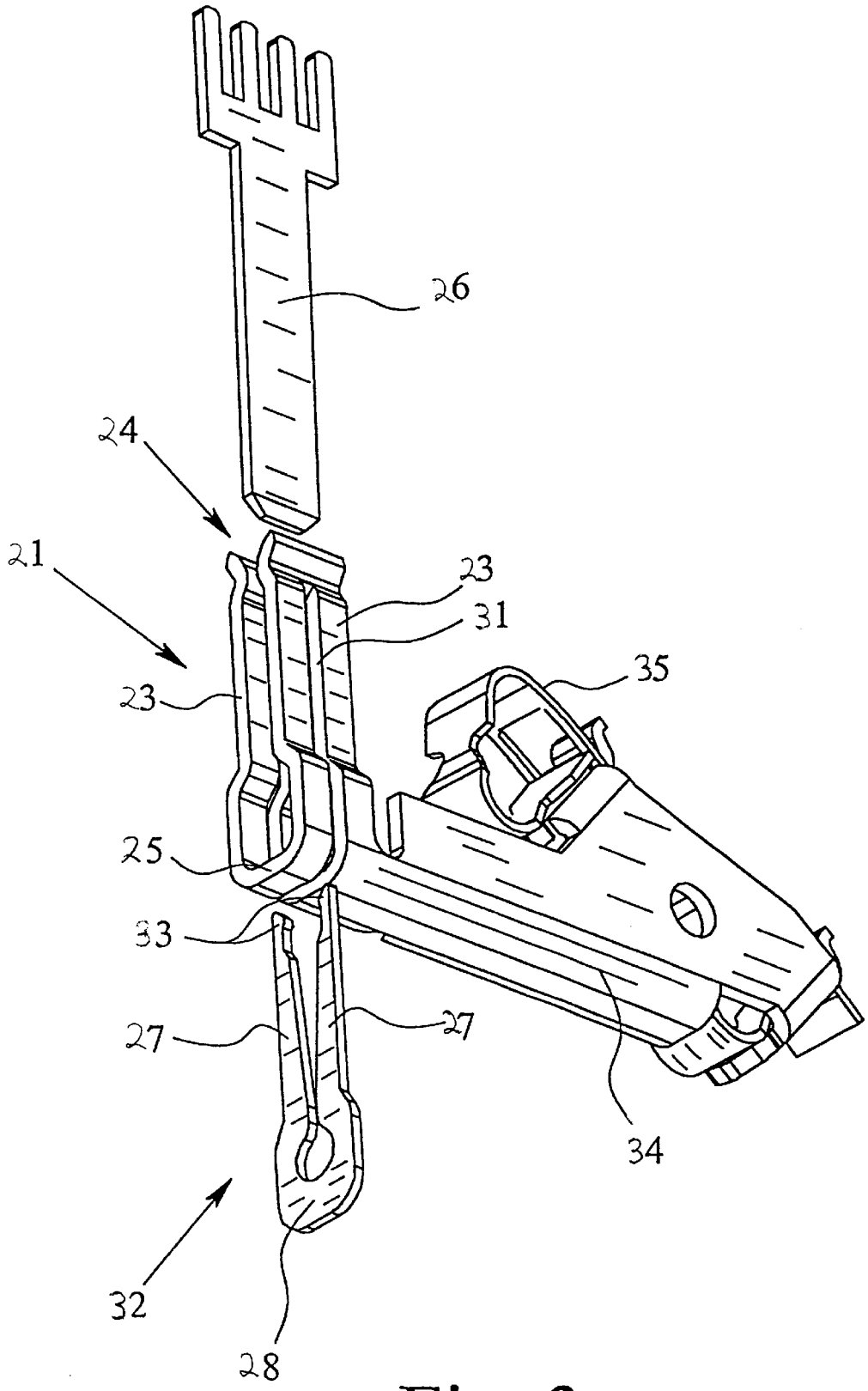
FIG. 3 shows an unassembled view of a second preferred embodiment of an electrical connector with a contact element connected to a current conductor piece, an additional spring element, and a mating contact element in accordance with the present invention.

If a mating contact element 26 such as that shown in FIG. 3 is inserted into the contact zone, the contact legs 13 of the contact element 10 and the legs 17 of the additional spring element 12 are pressed apart and thus, the contact element 10 and the additional spring element 12 are exposed to bending stress. Thus, the direction of stress is opposite the direction of the contact force F. In the type of stress which occurs here, the spring stiffness is thus, only linearly proportional to the width 20 of the additional spring element 12, but cubed depending on the thickness 19 of the additional spring element 12. It is readily apparent from this that the arrangement of the additional spring element 12 as provided by the present invention according to the embodiment shown in FIG. 2 greatly increases the spring stiffness of the electrical connector compared to the known prior art electrical connectors as shown in FIG. 1. If the spring stiffness of the additional spring element 12 is increased in the direction of stress, the contact force applied to the mating contact element 26 which has been inserted into the contact zone 14 is likewise increased.

Figure 4:
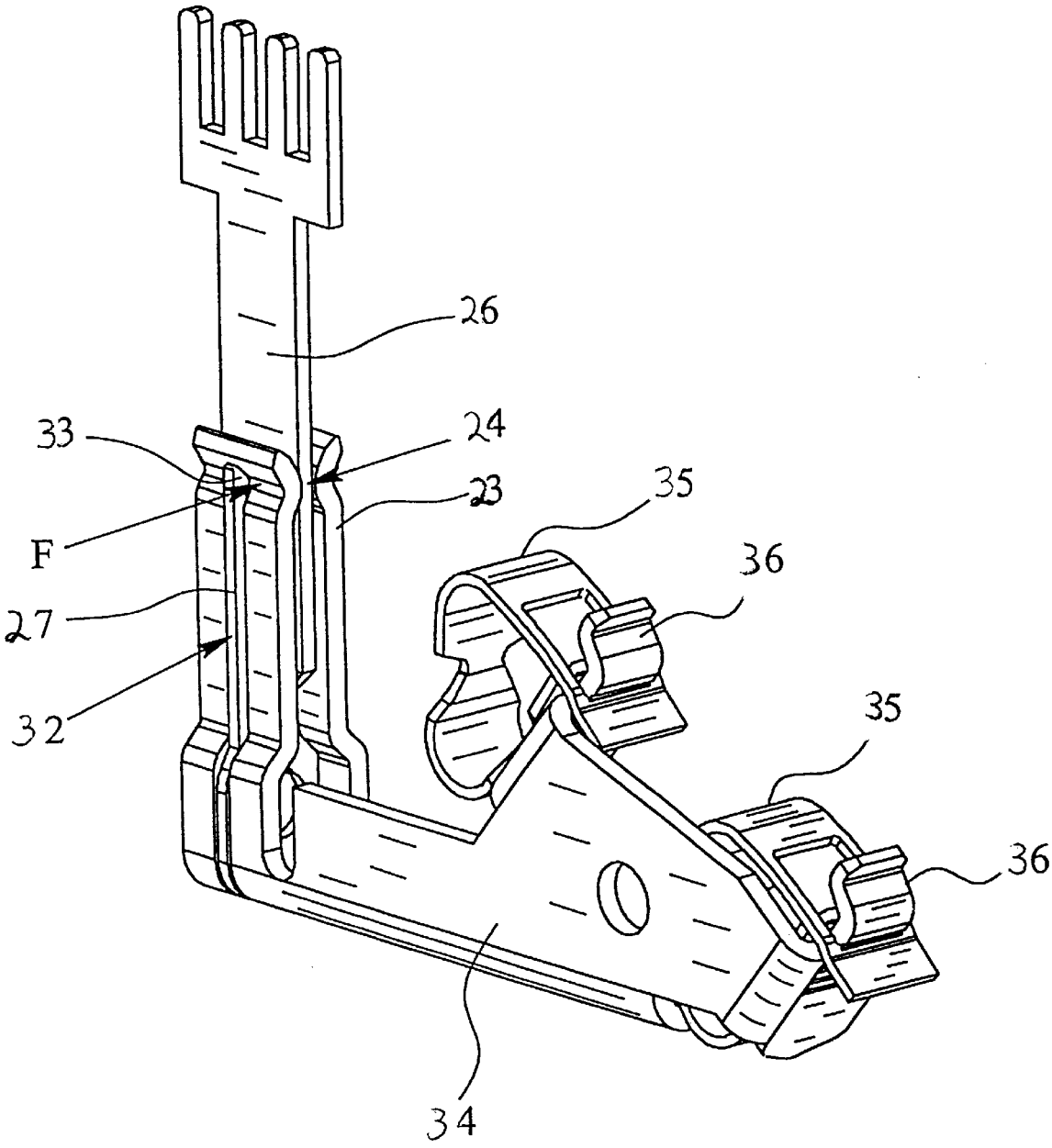
FIG. 4 shows the assembled view of the electrical connector of FIG. 3 where the mating contact element has been inserted into the connector.

In the preferred embodiment of the electrical connector shown in FIGS. 3 and 4, the contact element 21 has a slot 31 in the lengthwise direction. The additional spring element as described below can be inserted into this slot 31. The additional spring element is thus made as a retaining ring 32 which is deformed in an oblong manner. The retaining ring 32, in contrast to a round retaining ring, is deformed in an oblong manner to the extent that the contact element 21 has a roughly rectangular lengthwise section. By making a slot 31 in the contact element 21, an electrical connector which is rather compact overall can be made. Comparison of FIGS. 2 and 4 makes it clear that when the retaining ring 32 is inserted into the slot 31, the thickness of the entire electrical connector compared to the thickness of the contact element 21 is not increased or only insignificantly increased by the additional spring element 32.

FIGS. 3 and 4 moreover show that the ends of the contact legs 23 of the contact element 21 are bent in a wedge-shape or triangle shape into the contact zone 24. In this way, the contact zone 24 is fixed relative to the lengthwise extension of the contact element 21 since the contact zone 24 is the area on which the two contact legs 23 have the shortest distance from one another. The distance of the contact legs 23 toward the open end of the contact element 21 again becomes somewhat larger due to the wedge-shaped or triangular configuration of the ends of the contact legs 23. In this way, the insertion of a mating contact element 26 into the contact element 21 is facilitated since the ends of the contact legs 23 viewed from the insertion direction of the mating contact element 26 are arranged in a funnel-shape or V-shape to one another.

The attachment of the retaining ring 32 to the contact element 21 is facilitated by the ends 33 of the legs 27 being made wedge-shaped or triangular corresponding to the ends of the contact legs 23 of the contact element 21. Thus, the ends 33 of the legs 27 can be locked into the recesses in the contact legs 23 which are formed by the ends of the contact legs 23 being bent in a wedge-shape into the contact zone 24. In this way, unintentional loosening of the retaining ring 32 from the contact element 21 is prevented. In addition, this ensures that the reset force of the additional spring element 32 which results from the elastic deformation when the mating contact element 26 is inserted into the contact zone 24 is pointed at the contact zone 24.

To achieve especially good electrical contact between the contact element 21 and the mating contact element 26, the contact element 21 is preferably made of a material with high electrical conductivity, for example, copper or silver, and alloys thereof, and the additional spring element 32 is made of a high strength material, for example, spring steel.

In addition, in the embodiment shown in FIGS. 3 and 4, the contact element 21 is connected to the current conductor piece 34 as one integrated piece, the conductor piece 34 being connected to a conductor terminal element such as the two tension spring clamps 35. In the present embodiment, the current bars 36 assigned to the two tension spring clamps 35 are each formed by part of the current conductor piece 34. Electrical cables can be electrically connected conductively to the contact element 21 via the tension spring clamps 35 which correspondingly receive the mating contact element 26 which is inserted into the electrical connector.

Moreover, as previously noted, the additional spring element can be made advantageously as a Seeger circlip ring which is deformed in an oblong manner. Here, the retaining ring or the Seeger circlip ring is deformed in an oblong manner to the extent that the contact element is made not annular, but rather, is made rectangular.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

What is claimed is:

1. Electrical connector comprising:

a contact element having two contact legs which form a contact zone and a bent spring area connecting the contact legs, the bent spring area being adapted to apply a contact force to a mating contact element inserted into the contact zone; and an additional spring element having two legs and a bridge connecting the legs, the additional spring element being adapted to be secured to the contact element in a manner that stretching of the additional spring element in a direction of the contact force is greater than stretching of the additional spring element perpendicular to the direction of the contact force;

wherein the contact element includes a slot in a lengthwise direction of the contact element, and the additional spring element is secured to the contact element by being inserted into the slot; and wherein the slot extends continuously from one contact leg to the other contact leg through the spring area.

2. Electrical connector as claimed in claim 1, wherein the additional spring element is comprises a retaining ring having an oblong shape.

3. Electrical connector as claimed in claim 2, wherein the additional spring element is a retaining ring conforming with German standard DIN 471 and having an oblong shape.

4. Electrical connector as claimed in claim 1, wherein the contact element is made of a material with high electrical conductivity selected from a group consisting of copper, silver, and alloys thereof, and the additional spring element is made of spring steel.

5. Electrical connector as claimed in claim 4, wherein the contact element is connected to a current conductor piece in one integrated piece and the current conductor piece is connected to at least one conductor terminal element.

6. Electrical connector as claimed in claim 5, wherein the at least one conductor terminal element is a tension spring clamp with a current bar formed by a portion of the current conductor piece.

7. Electrical connector as claimed in claim 1, wherein the contact element is connected to a current conductor piece in one integrated piece and the current conductor piece is connected to at least one conductor terminal element.

8. Electrical connector as claimed in claim 7, wherein the at least one conductor terminal element is a tension spring clamp with a current bar formed by a portion of the current conductor piece.

9. Electrical connector as claimed in claim 1, wherein ends of the contact legs of the contact element are bent into the contact zone in at least one of a wedge shape and a triangular shape.

10. Electrical connector as claimed in claim 9, wherein ends of the legs of the additional spring element have at least one of a wedge shape and a triangular shape corresponding to the ends of the contact legs of the contact element.

11. Electrical connector as claimed in claim 10, wherein the contact element is made of a material with high electrical conductivity selected from a group consisting of copper, silver, and alloys thereof.

12. Electrical connector as claimed in claim 10, wherein the additional spring element is made of spring steel.

* * * * *